US011160385B2

(12) United States Patent
Tsai et al.

(10) Patent No.: US 11,160,385 B2
(45) Date of Patent: Nov. 2, 2021

(54) LIGHTWEIGHT FOLDABLE BED WITH REINFORCING UNIT

(71) Applicant: ULIFE HEALTHCARE INC., Taoyuan (TW)

(72) Inventors: Chi-Lung Tsai, Taichung (TW); Ling Wu, Taoyuan (TW)

(73) Assignee: ULIFE HEALTHCARE INC., Taoyuan (TW)

( * ) Notice: Subject to any disclaimer, the term of this patent is extended or adjusted under 35 U.S.C. 154(b) by 83 days.

(21) Appl. No.: 16/507,217

(22) Filed: Jul. 10, 2019

(65) Prior Publication Data

US 2020/0367660 A1 Nov. 26, 2020

(30) Foreign Application Priority Data

May 22, 2019 (TW) ..... 108206432

(51) Int. Cl.
*A47C 20/04* (2006.01)

(52) U.S. Cl.
CPC ..... *A47C 20/04* (2013.01); *A47C 20/041* (2013.01)

(58) Field of Classification Search
CPC ..... A47C 20/041; A47C 20/04; A47C 20/10; A47C 20/08; A47C 20/12; A47C 19/122; A61G 7/015
USPC ..... 5/618
See application file for complete search history.

(56) References Cited

U.S. PATENT DOCUMENTS 1,360,983 A * 11/1920 Burton ..... A47C 19/122 5/154
5,090,071 A * 2/1992 Bathrick ..... A47C 19/122 5/174
5,669,090 A * 9/1997 Basgall ..... A61G 7/002 5/611
10,321,767 B2 * 6/2019 Jin ..... A47C 19/12
2001/0000828 A1 * 5/2001 Hensley ..... A47C 20/08 5/618
2010/0325799 A1 * 12/2010 Huang ..... A47C 20/08 5/616
2017/0360209 A1 * 12/2017 Zhou ..... A61G 7/1074
2018/0116414 A1 * 5/2018 Lo ..... A47C 21/046
2018/0125249 A1 * 5/2018 Chung ..... A47C 19/021
2018/0125252 A1 * 5/2018 Chung ..... A47C 19/025
2018/0235373 A1 * 8/2018 Tsai ..... A47C 19/025
2019/0069683 A1 * 3/2019 Gajjar ..... A47C 19/122
2019/0191890 A1 * 6/2019 Huang ..... A47C 20/08
2019/0223607 A1 * 7/2019 Ji ..... A47C 20/04
2019/0328593 A1 * 10/2019 Choi ..... A61G 7/015
(Continued)

*Primary Examiner* — Myles A Throop
(74) *Attorney, Agent, or Firm* — Allen, Dyer, Doppelt + Gilchrist, PA

(57) ABSTRACT

A foldable bed includes first and second base frames, first and second rods fixed respectively to the first and second base frames, a first support frame mounted turnably to the first base frame, a first jack member coupled between the first rod and the first support frame for driving movement of the first support frame, and at least one reinforcing unit. The reinforcing unit includes a first reinforcing plate mounted on one of the first and second rods. When the first and second base frames are in an unfolded position, the first reinforcing plate is brought into abutting engagement with the other one of the first and second rods so as to distribute a pressure from the first jack member to the second base frame through the second rod.

12 Claims, 9 Drawing Sheets

(56) References Cited

U.S. PATENT DOCUMENTS

| | | | | |
|---|---|---|---|---|
| 2020/0000242 | A1* | 1/2020 | Ermalovich | A47C 20/04 |
| 2020/0187662 | A1* | 6/2020 | Zeng | A47C 20/041 |
| 2020/0205576 | A1* | 7/2020 | Choi | A47C 19/025 |

* cited by examiner

LIGHTWEIGHT FOLDABLE BED WITH REINFORCING UNIT

CROSS-REFERENCE TO RELATED APPLICATION

This application claims priority from Taiwanese utility model patent application no. 108206432, filed on May 22, 2019.

FIELD

The disclosure relates to a modular bed, more particularly to a lightweight foldable modular bed with a reinforcing unit.

BACKGROUND

Referring to FIGS. 1 and 2, a conventional foldable bed is shown to include two base frame units 10, two support frame units 20, two jack members 30, and a bed panel unit 40.

Each of the base frame units 10 includes an outer frame 101, a transverse bar 102 mounted to the outer frame 101, a reinforcing bar 103 mounted to the outer frame 101 and spaced apart from the transverse bar 102, and a connection bar 104 extending to interconnect the transverse and reinforcing bars 102, 103. The outer frames 101 of the base frame units 10 are pivotally connected to each other.

The support frame units 20 are turnably and respectively mounted to the outer frames 101 of the base frame units 10 between a normal position and an elevated position.

Each of the jack members 30 is coupled between one of the support frame units 20 and the transverse bar 102 of a respective one of the base frame units 10, and includes a driving motor 301 and a telescoping tube unit 302 which is driven by the driving motor 301 to move the respective support frame unit 20 between the normal and elevated positions.

The bed panel unit 40 includes a plurality of bed panels 401 supported by the base frame units 10 and the support frame units 20.

When a user lies on the bed panels 401, he or she can actuate at least one of the jack members 30 to elevate or lower down the head or legs of the user on the bed panels 401. When the bed panel(s) 401 for supporting the head or the legs of the user is (are) elevated, the weight of the user is applied on the corresponding transverse bar 102 through the corresponding jack member 30, and the pressure from the user's weight is further distributed to the corresponding reinforcing bar 103 through the corresponding connection bar 104.

The provision of the reinforcing bars 103 and the connection bars 104 is useful for preventing deformation of the transverse bars 102. However, there is still a need for reducing the weight and cost of the foldable bed.

SUMMARY

Therefore, an object of the disclosure is to provide a lightweight foldable bed with a reinforcing unit.

According to the disclosure, a foldable bed includes a first base frame, a second base frame, a first rod, a second rod, a first support frame, a first jack member, and at least one reinforcing unit. The first and second base frames are connected to permit the first and second base frames to be convertible between a folded position, where the first and second base frames are folded relative to each other, and an unfolded position, where the first and second base frames are aligned in the longitudinal direction. Each of the first and second rods extends in a transverse direction relative to the longitudinal direction. The first and second rods are respectively fixed to the first and second base frames, and are disposed in proximity to the second and first base frames, respectively. The first support frame is turnably mounted to the first base frame and turnable between a first normal position and a first elevated position. The first jack member is coupled between the first rod and the first support frame so as to permit the first support frame to be driven by the first jack member to move between the first normal position and the first elevated position. The reinforcing unit includes a first reinforcing plate which is mounted on one of the first and second rods, and which is configured such that when the first and second base frames are in the unfolded position, the first reinforcing plate is brought into abutting engagement with the other one of the first and second rods so as to distribute a pressure from the first jack member to the second base frame through the second rod.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 3:
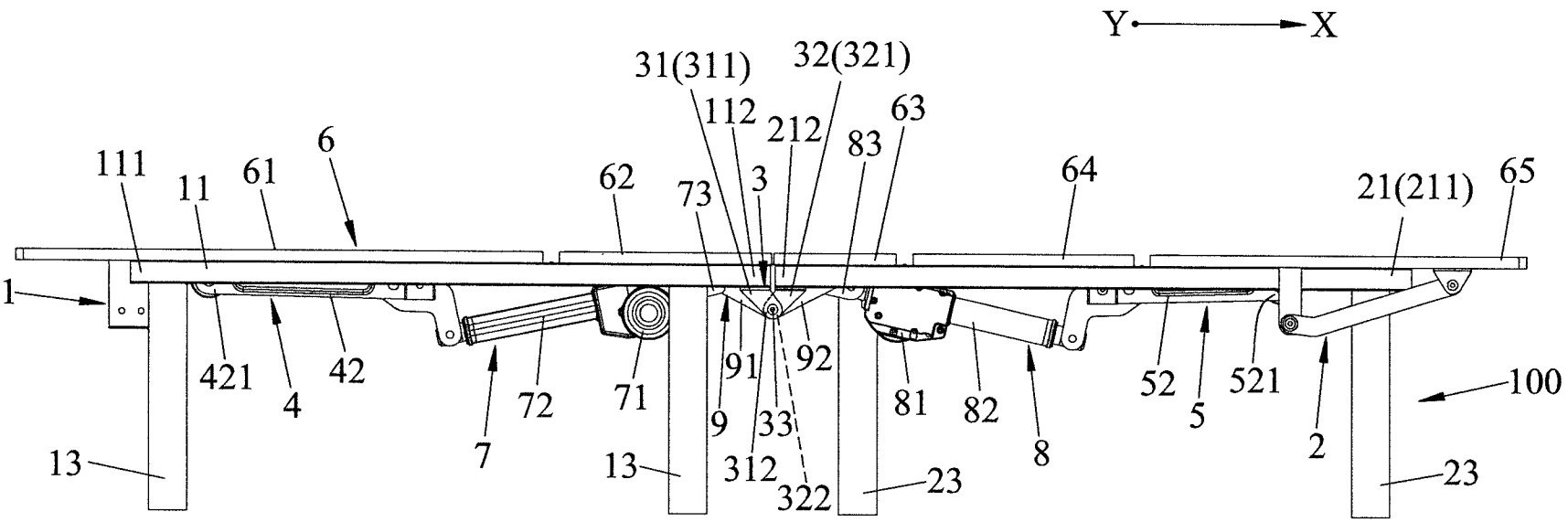
FIG. 3 is a side view of a lightweight foldable bed according to an embodiment of the disclosure.
Figure 4:
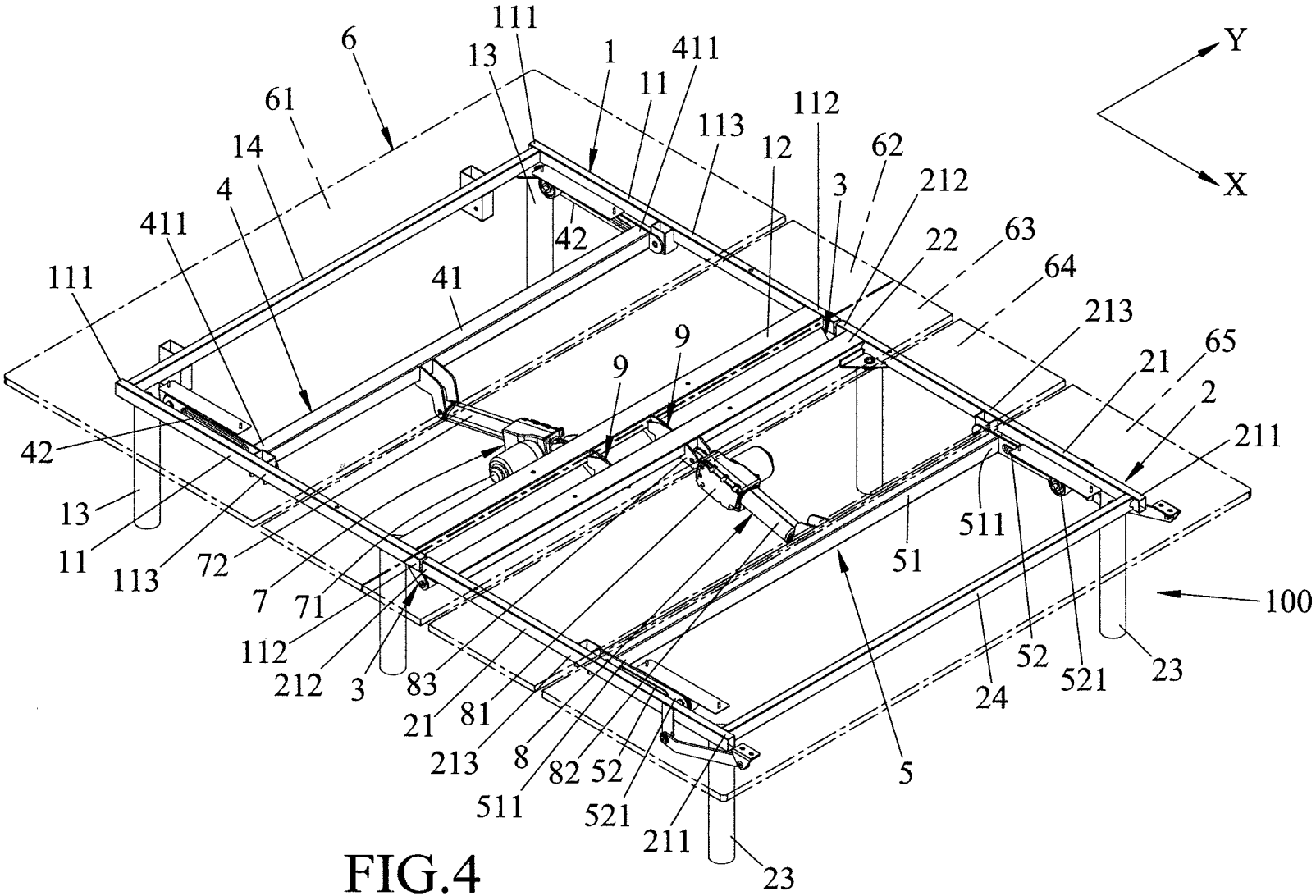
FIG. 4 is a perspective view of the lightweight foldable bed.

Referring to FIGS. 3 and 4, a lightweight foldable bed according to an embodiment of the disclosure is shown to include a first base frame 1, a second base frame 2, a first rod 12, a second rod 22, a first support frame 4, a first jack member 7, and at least one reinforcing unit 9.

The first and second base frames 1, 2 are connected to permit the first and second base frames 1, 2 to be convertible between a folded position and an unfolded position. In the folded position, the first and second base frames 1, 2 are folded relative to each other to permit the foldable bed to have a reduced volume. In the unfolded position, as shown in FIG. 4, the first and second base frames 1, 2 are aligned in the longitudinal direction (X).

Figure 9:
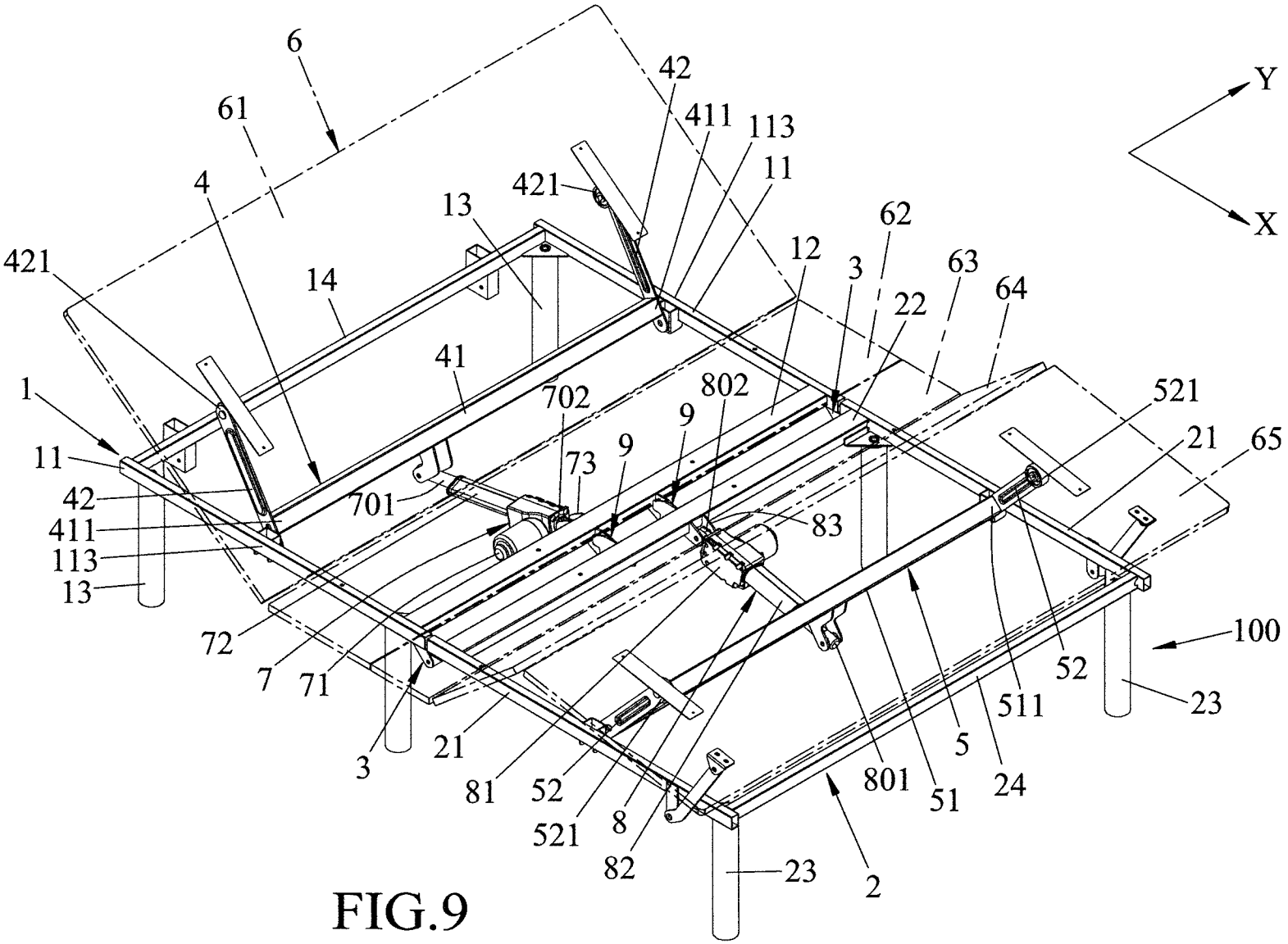
FIG. 9 is similar to FIG. 4 but illustrating the first and second support frames respectively in the first and second elevated positions.

In an embodiment shown in FIGS. 4 and 9, the first base frame 1 includes two front bars 11 and a front transverse bar 14. The front bars 11 are spaced apart from each other in the transverse direction (Y), and each of the front bars 11 extends in the longitudinal direction (X) to terminate at a front end segment 111 and a front pivot end segment 112, and has a front intermediate segment 113 between the front end segment 111 and a front pivot end segment 112. The front transverse bar 14 extends in a transverse direction (Y) relative to the longitudinal direction (X) to interconnect the front end segments 111 of the front bars 11.

In addition, the second base frame 2 includes two rear bars 21 and a rear transverse bar 24. Each of the rear bars 21 extends in the longitudinal direction (X) to terminate at a rear end segment 211 and a rear pivot end segment 212 which is pivotally connected to the front pivot end segment 112 of a respective one of the front bars 11, so as to permit the first and second base frames 1, 2 to be convertible between the folded and unfolded positions. Each of the rear bars 21 has a rear intermediate segment 213 between the rear end segment 211 and a rear pivot end segment 212. The rear transverse bar 24 extends in the transverse direction (Y) to interconnect the rear end segments 211 of the rear bars 21.

Each of the first and second rods 12, 22 extends in the transverse direction (Y). The first and second rods 12, 22 are respectively fixed to the first and second base frames 1, 2, and are disposed in proximity to the second and first base frames 2, 1, respectively.

In an embodiment shown in FIGS. 4 and 9, the first rod 12 extends to interconnect the first pivot end segments 112 of the front bars 11, and the second rod 22 extends to interconnect the second pivot end segments 212 of the rear bars 21.

Figure 8:
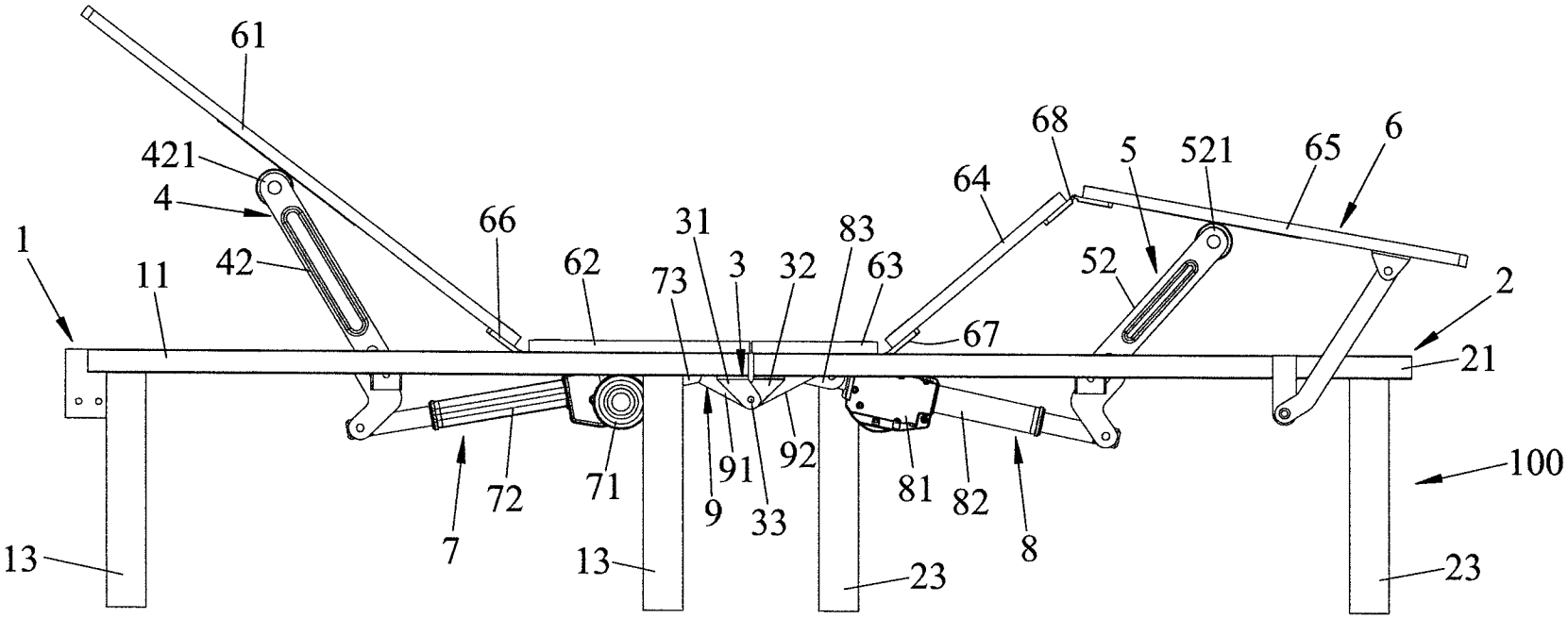
FIG. 8 is similar to FIG. 3 but illustrating first and second support frames of the lightweight foldable bed respectively in first and second elevated positions.

The first support frame 4 is turnably mounted to the first base frame 1 and turnable between a first normal position (FIGS. 3 and 4, a head normal position) and a first elevated position (FIGS. 8 and 9, a head elevated position).

In an embodiment shown in FIGS. 4 and 9, the first support frame 4 includes a first transverse bar 41 and a pair of first support arms 42. The first transverse bar 41 extends in the transverse direction (Y) to terminate at two first end segments 411 which are pivotally connected to the front intermediate segments 113 of the front bars 11, respectively. Each of the first support arms 42 extends radially from a respective one of the first end segments 411 to terminate at a first support end 421.

The first jack member 7 is coupled between the first rod 12 and the first support frame 4 so as to permit the first support frame 4 to be driven by the first jack member 7 to move between the first normal position and the first elevated position.

In an embodiment shown in FIGS. 4 and 9, the first jack member 7 is coupled between the first rod 12 and the first transverse bar 41 to drive the movement of the first support frame 4. When the first support frame 4 is in the first normal position (FIGS. 3 and 4), the first support ends 421 of the first support arms 42 are close to the ground. When the first support frame 4 is in the first elevated position (FIGS. 8 and 9), the first support ends 421 of the first support arms 42 are remote from the ground.

Figure 7:
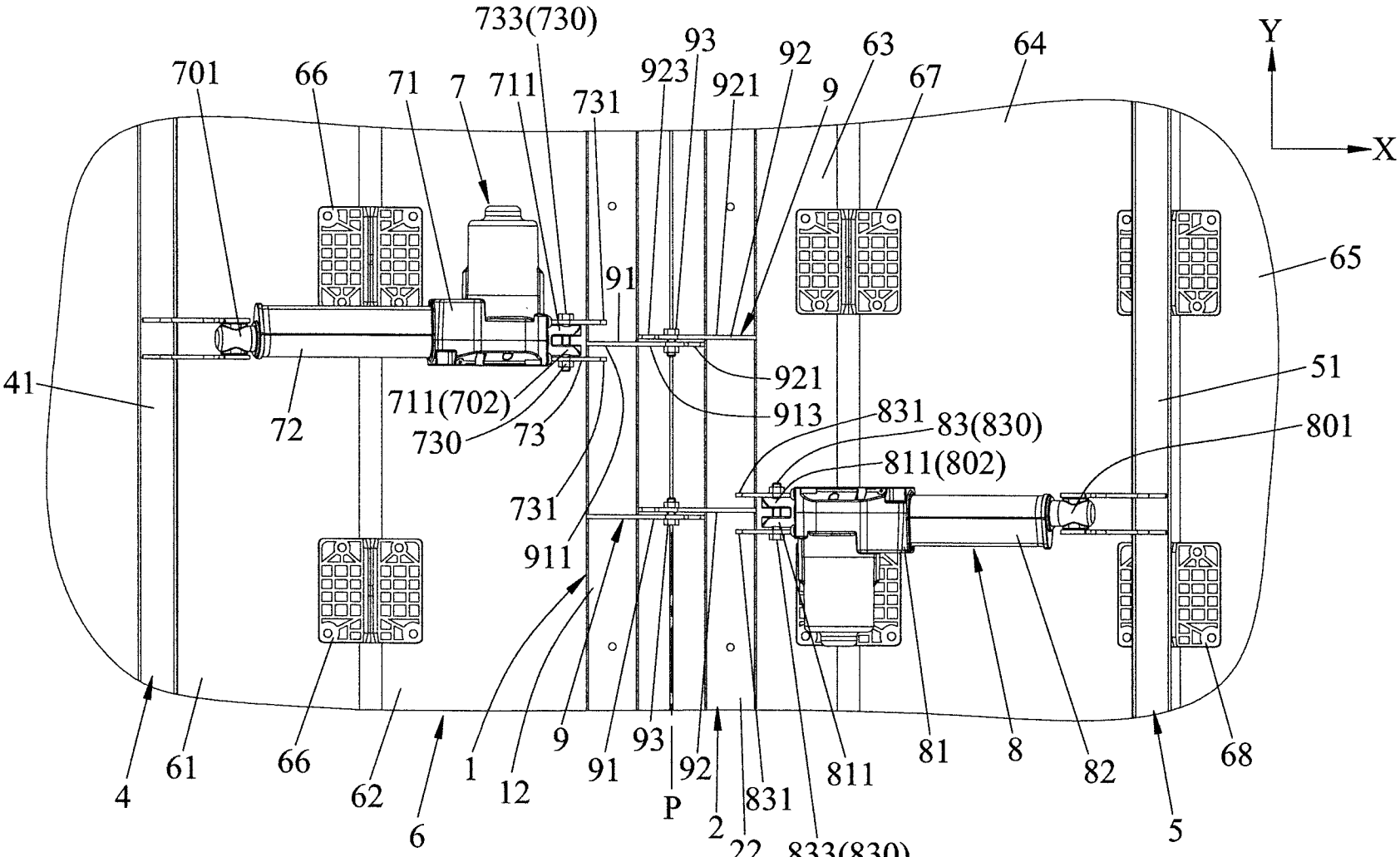
FIG. 7 is fragmentary enlarged bottom view of the lightweight foldable bed.

In an embodiment shown in FIG. 7, the first jack member 7 includes a first rest end 701 which is coupled to one of the first rod 12 and the first transverse bar 41, and a first pivoted end 702 which is pivotally mounted to the other of the first rod 12 and the first transverse bar 41 so as to permit the first support frame 4 to be driven to move between the first normal position (FIGS. 3 and 4) and the first elevated position (FIGS. 8 and 9).

In an embodiment shown in FIG. 7, the first rest end 701 is coupled to the first transverse bar 41, and the first pivoted end 702 is pivotally mounted to the first rod 12. In addition, the first jack member 7 includes a first driving motor 71 and a first telescoping tube unit 72 which has the first rest end 701 and the first pivoted end 702, and which is driven by the first driving motor 71 to move the first support frame 4 between the first normal and elevated positions.

In an embodiment shown in FIG. 7, the first pivoted end 702 is formed with two lugs 711 and is pivotally mounted to the first rod 12 via a connection unit 73. The connection unit 73 includes a first connection pin 733 and a pair of first connection pieces 731. The first connection pin 733 extends through the lugs 711 of the first pivoted end 702 in the transverse direction (Y) to terminate at two first pin ends 730. The first connection pieces 731 are disposed outboard of the first pivoted end 702 to respectively connect the first pin ends 730 with the first rod 12 so as to permit the first pivoted end 702 to be pivotally mounted to the first rod 12.

Figure 5:
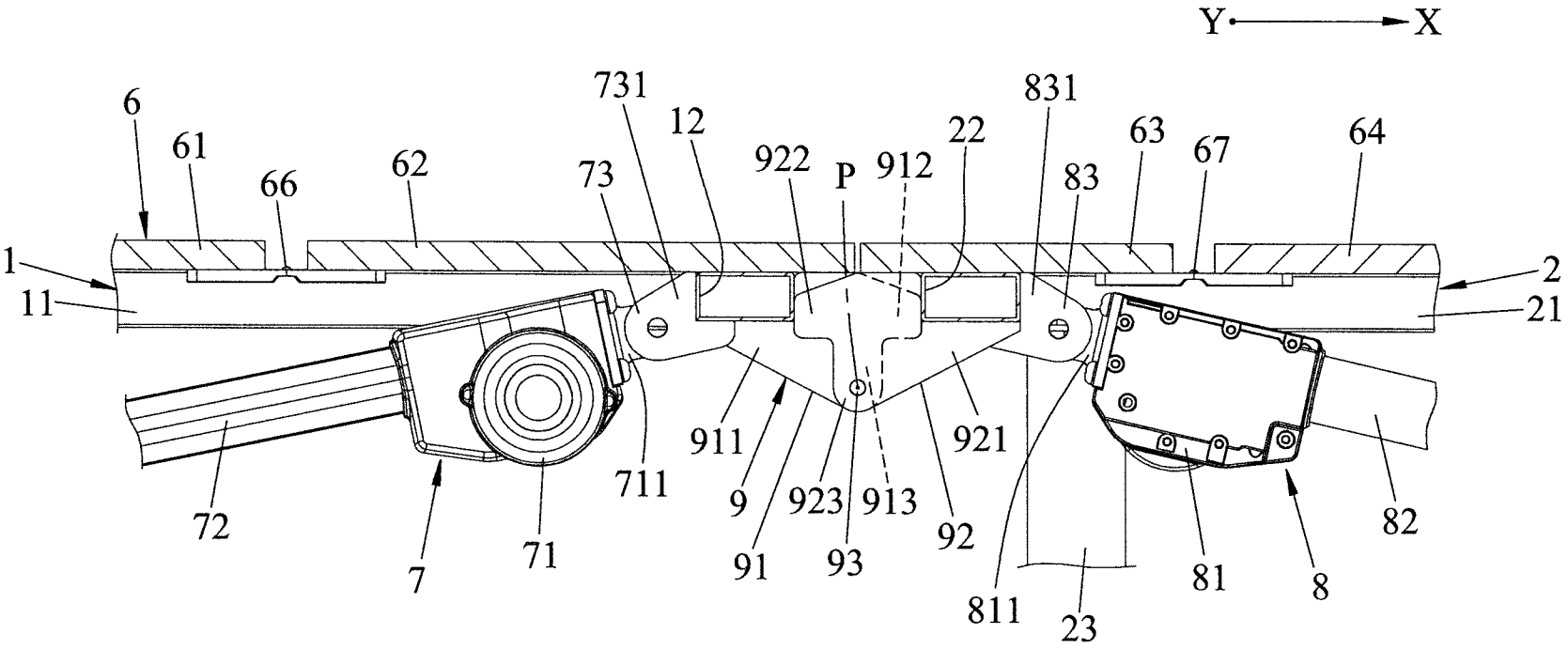
FIG. 5 is a fragmentary enlarged cross-sectional view of the lightweight foldable bed.

As shown in FIGS. 5 and 7, the reinforcing unit 9 includes a first reinforcing plate 91 which is mounted on one of the first and second rods 12, 22, and which is configured such that when the first and second base frames 1, 2 are in the unfolded position (see FIG. 5), the first reinforcing plate 91 is brought into abutting engagement with the other one of the first and second rods 12, 22 so as to distribute a pressure from the first jack member 7 to the second base frame 2 through the second rod 22. Furthermore, with the provision of the reinforcing unit 9, the first and second base frames 1, 2 may be further stabilized in the unfolded position.

Figure 6:
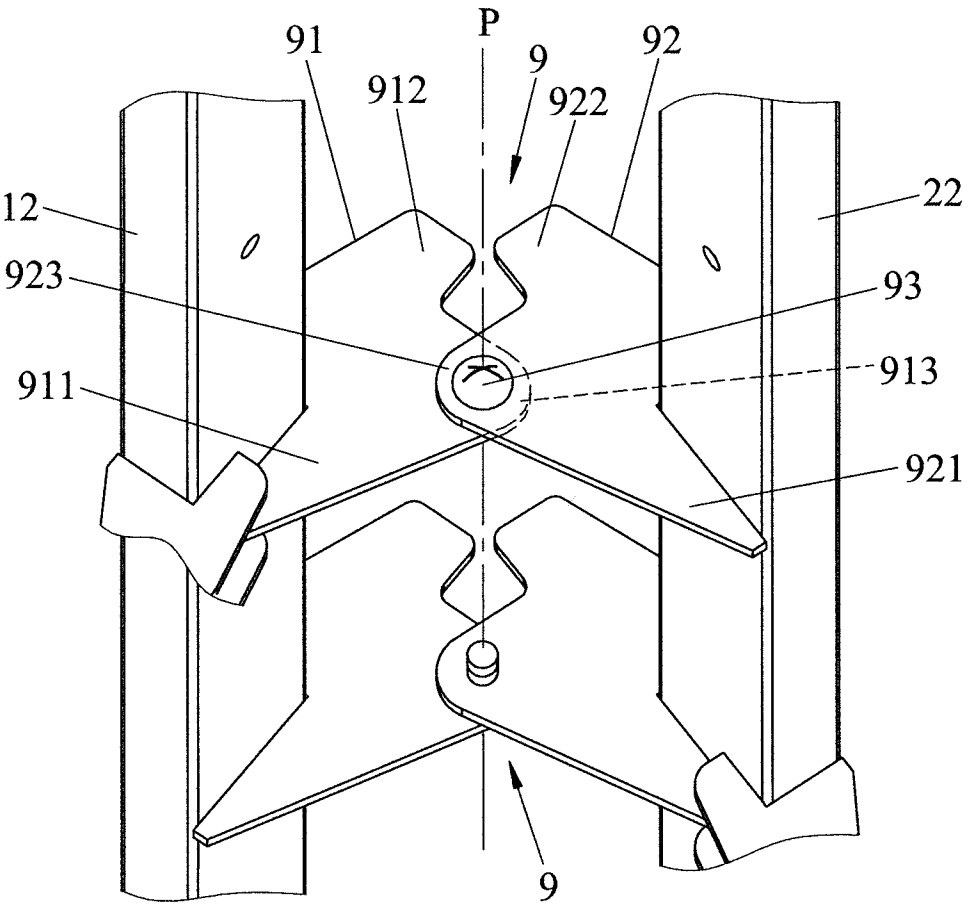
FIG. 6 is a fragmentary enlarged perspective view illustrating first and second base frames of the lightweight foldable bed being moved toward a folded position.

In an embodiment shown in FIGS. 5 to 7, the first reinforcing plate 91 has a first mounted region 911, a first abutting region 912, and a first pivot region 913. The first mounted region 911 is mounted on the first rod 12. The first abutting region 912 is configured to be brought into abutting engagement with the second rod 22 when the first and second base frames 1, 2 are in the unfolded position (see FIG. 5). The first pivot region 913 is disposed between the first mounted region 911 and the first abutting region 912.

In addition, the first reinforcing unit 9 further includes a second reinforcing plate 92 and a first pivot pin 93.

The second reinforcing plate 92 has a second mounted region 921, a second abutting region 922, and a second pivot region 923. The second mounted region 921 is mounted on the second rod 22. The second abutting region 922 is configured to be brought into abutting engagement with the first rod 12 when the first and second base frames 1, 2 are in the unfolded position (see FIG. 5). The second pivot region 923 is disposed between the second mounted region 921 and the second abutting region 922.

The first pivot pin 93 extends along a pin axis (P) in the transverse direction (Y) through the first and second pivot regions 913, 923 so as to permit rotation of the first reinforcing plate 91 relative to the second reinforcing plate 92 during conversion of the first and second base frames 1, 2 between the folded and unfolded positions.

As shown in FIGS. 5 and 6, to move the first and second base frames 1, 2 toward the folded position (not shown) from the unfolded position (FIG. 5), the second reinforcing plate 92 together with the second base frame 2 is turned in a clockwise direction about the pin axis (P), and the first reinforcing plate 91 together with the first base frame 1 is turned in a counterclockwise direction about the pin axis (P).

In an embodiment shown in FIGS. 6 and 7, the lightweight foldable bed may include a plurality of the reinforcing units 9 which are displaced from each other in the transverse direction (Y).

In an embodiment shown in FIGS. 3 and 4, the lightweight foldable bed further includes a pair of pivotal connection units 3 each including a first connection plate 31, a second connection plate 32, and a second pivot pin 33. The first connection plate 31 has a first connection end 311 which is connected to the front pivot end segment 112 of a respective one of the front bars 11, and a first pivotal end 312 which is opposite to the first connection end 311. The second connection plate 32 has a second connection end 321 which is connected to the rear pivot end segment 212 of a respective one of the rear bars 21, and a second pivotal end 322 which is opposite to the second connection end 321. The second pivot pin 33 extends along the pin axis (P) shown in FIGS. 6 and 7 through the first and second pivotal ends 312, 322 so as to permit the rear pivot end segment 212 to be pivotally connected to the front pivot end segment 112 of the respective front bar 11, and to permit rotation of the first connection plate 31 relative to the second connection plate 32 during the conversion of the first and second base frames 1, 2 between the folded and unfolded positions.

In an embodiment shown in FIGS. 3, 4, 8, and 9, the lightweight foldable bed further includes a leg assembly 100 which is configured to sustain the first and second base frames 1, 2 in the unfolded position, and which includes a plurality of legs 13, 23. As shown in FIG. 4, the legs 13 are mounted beneath the first base frame 1, and the legs 23 are mounted beneath the second base frame 2.

In an embodiment shown in FIGS. 3, 4, 8, and 9, the lightweight foldable bed further includes a second support frame 5 and a second jack member 8.

The second support frame 5 includes a second transverse bar 51 and a pair of second support arms 52. The second transverse bar 51 extends in the transverse direction (Y) to terminate at two second end segments 511 which are pivotally connected to the rear intermediate segments 213 of the rear bars 21, respectively. Each of the second support arms 52 extends radially from a respective one of the second end segments 511 to terminate at a second support end 521.

The second jack member 8 is coupled between the second rod 22 and the second transverse bar 51 so as to permit the second support frame 5 to be driven by the second jack member 8 to move between a second normal position (a leg normal position) and a second elevated position (a leg elevated position). In the second normal position, as shown in FIGS. 3 and 4, the second support ends 521 of the second support arms 52 are close to the ground. In the second elevated position, as shown in FIGS. 8 and 9, the second support ends 521 of the second support arms 52 are remote from the ground.

In an embodiment shown in FIG. 7, the second jack member 8 includes a second rest end 801 which is coupled to one of the second rod 22 and the second transverse bar 51, and a second pivoted end 802 which is pivotally mounted to the other of the second rod 22 and the second transverse bar 51 so as to permit the second support frame 5 to be driven to move between the second normal position (FIGS. 3 and 4) and the second elevated position (FIGS. 8 and 9).

In an embodiment shown in FIG. 7, the second rest end 801 is coupled to the second transverse bar 51, and the second pivoted end 802 is pivotally mounted to the second rod 22. In addition, the second jack member 8 includes a second driving motor 81 and a second telescoping tube unit 82 which has the second rest end 801 and the second pivoted end 802, and which is driven by the second driving motor 81 to move the second support frame 5 between the second normal and elevated positions.

In an embodiment shown in FIG. 7, the second pivoted end 802 is formed with two lugs 811 and is pivotally mounted to the second rod 22 via a connection unit 83. The connection unit 83 includes a second connection pin 833 and a pair of second connection pieces 831. The second connection pin 833 extends through the lugs 811 of the second pivoted end 802 in the transverse direction (Y) to terminate at two second pin ends 830. The second connection pieces 831 are disposed outboard of the second pivoted end 802 to respectively connect the second pin ends 830 with the second rod 22 so as to permit the second pivoted end 802 to be pivotally mounted to the second rod 22.

In an embodiment shown in FIGS. 3, 4, and 7 to 9, the lightweight foldable bed further includes bed panel unit 6 having a plurality of bed panels 61, 62, 63, 64, 65. The bed panel 61 is supported by the first support ends 421 of the first support frame 4 for elevating a head of a user. The bed panel 62 is fixed on and supported by the first pivot end segments 112 of the front bars 11 and is hingedly connected to the bed panel 61 via at least one hinge member 66. The bed panel 63 is fixed on and supported by the second pivot end segments 212 of the rear bars 21. The bed panel 64 is hingedly connected to the bed panel 63 via at least one hinge member 67. The bed panel 65 is hingedly connected to the bed panel 64 via at least one hinge member 68. The bed panel 65 is supported by the second support ends 521 of the first support frame 5 so as to permit legs of a user to be elevated by the bed panels 64, 65.

A suitable mattress (not shown) may be further disposed on the bed panel unit 6 for a user to lie thereon.

When a user lies on the bed panel unit 6 or the mattress, he or she can actuate at least one of the first and second jack members 7, 8 to elevate or lower down his or her head or legs by elevating the corresponding bed panel(s). When the bed panel 61 for supporting a head of a user is elevated, the weight of the user is applied on the first bar 12 through the first jack member 7, and the pressure from the user's weight is further distributed to the second base frame 2 through the reinforcing unit(s) 9 and the second bar 22. Similarly, when the bed panels 64, 65 for supporting legs of a user are elevated, the weight of the user is applied on the second bar 22 through the second jack member 8, and the pressure from the user's weight is further distributed to the first base frame 1 through the reinforcing unit(s) 9 and the first bar 12.

Figure 1:
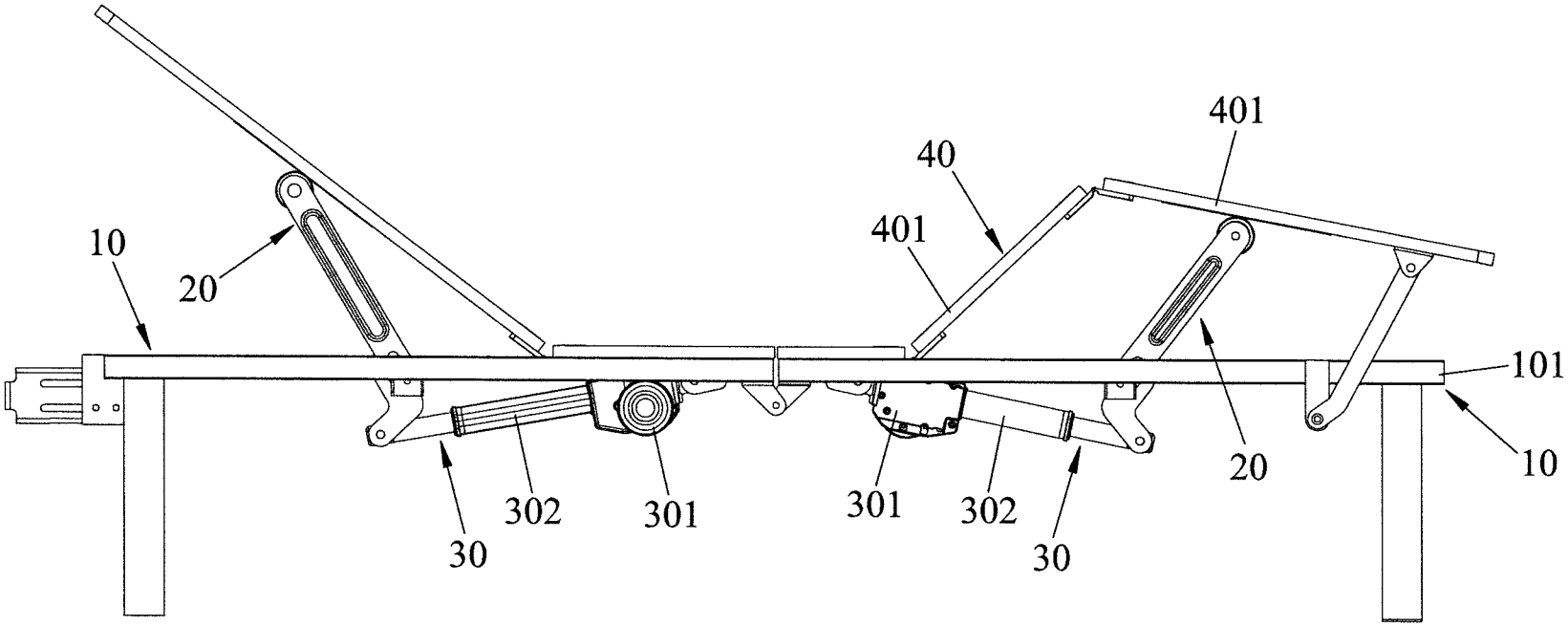
FIG.1 PRIOR ART
FIG. 1 is a side view of a conventional foldable bed.
Figure 2:
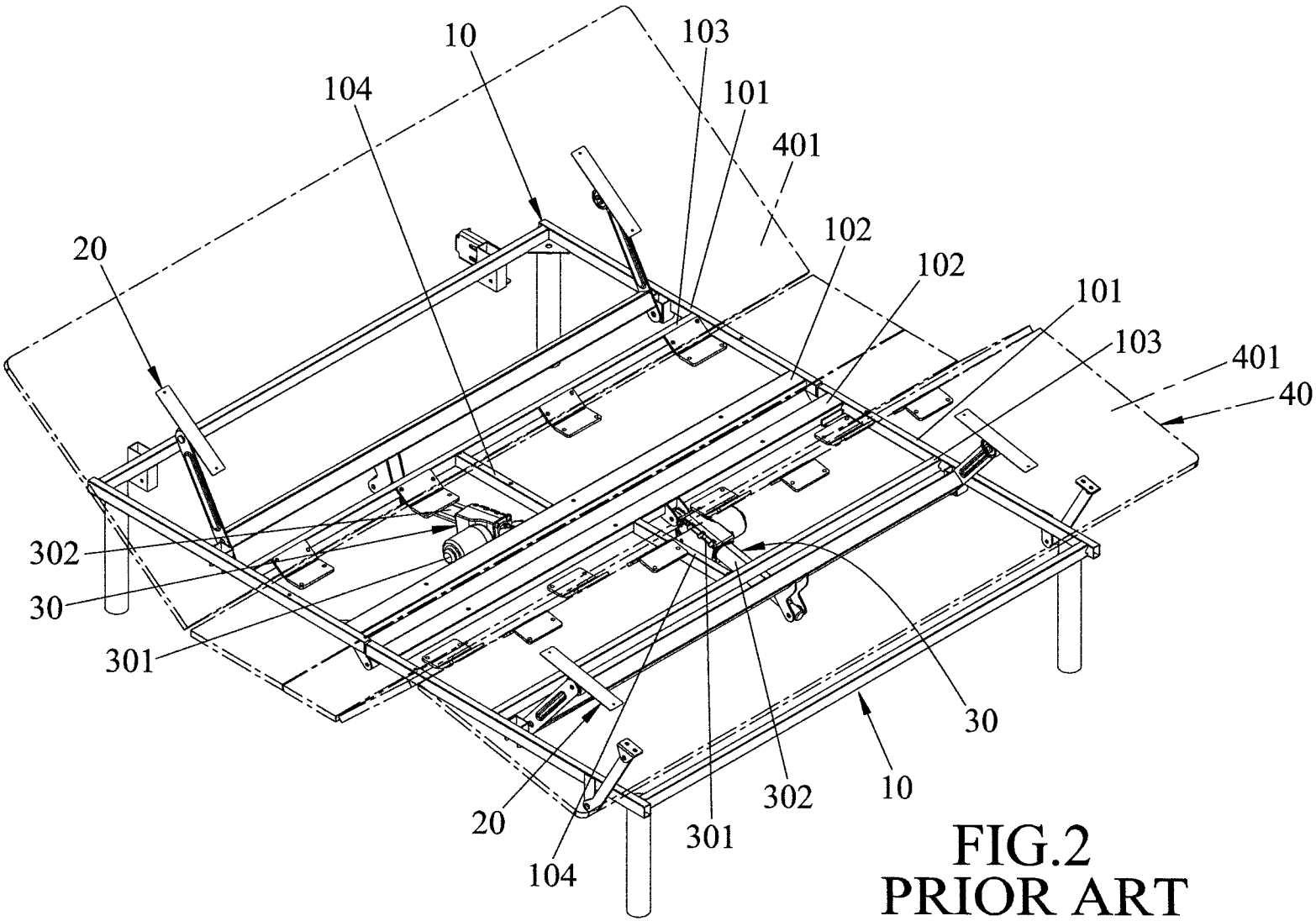
FIG.2 PRIOR ART
FIG. 2 is a perspective view of the conventional foldable bed.

Therefore, with the provision of the reinforcing unit 9, the first and second bars 12, 22 are less likely to deform due to the weight pressure from the user, and the foldable bed of the disclosure has a reduced weight compared to the conventional foldable bed illustrated in FIGS. 1 and 2.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A foldable bed comprising:

a first base frame and a second base frame which are connected to permit said first and second base frames to be convertible between a folded position, where said first and second base frames are folded relative to each other, and an unfolded position, where said first and second base frames are aligned in the longitudinal direction;

a first rod and a second rod, each extending in a transverse direction relative to the longitudinal direction, said first and second rods being respectively fixed to said first and second base frames, and being disposed in proximity to said second and first base frames, respectively;

a first support frame which is turnably mounted to said first base frame and which is turnable between a first normal position and a first elevated position;

a first jack member coupled between said first rod and said first support frame so as to permit said first support frame to be driven by said first jack member to move between the first normal position and the first elevated position; and at least one reinforcing unit including a first reinforcing plate which is mounted on one of said first and second rods, and which is configured such that when said first and second base frames are in the unfolded position, said first reinforcing plate is brought into abutting engagement with the other one of said first and second rods so as to distribute a pressure from said first jack member to said second base frame through said second rod.

2. The foldable bed according to claim 1, wherein said first base frame includes two front bars which are spaced apart from each other in the transverse direction, each of said front bars extending in the longitudinal direction to terminate at a front end segment and a front pivot end segment, and having a front intermediate segment between said front end segment and a front pivot end segment, and a front transverse bar extending in the transverse direction to interconnect said front end segments of said front bars;

said second base frame includes two rear bars each extending in the longitudinal direction to terminate at a rear end segment and a rear pivot end segment which is pivotally connected to said front pivot end segment of a respective one of said front bars, so as to permit said first and second base frames to be convertible between the folded and unfolded positions, each of said rear bars having a rear intermediate segment between said rear end segment and a rear pivot end segment, and a rear transverse bar extending in the transverse direction to interconnect said rear end segments of said rear bars;

said first rod extends to interconnect said first pivot end segments of said front bars;

said second rod extends to interconnect said second pivot end segments of said rear bars;

said first support frame includes a first transverse bar extending in the transverse direction to terminate at two first end segments which are pivotally connected to said front intermediate segments of said front bars, respectively, and a pair of first support arms each extending radially from a respective one of said first end segments to terminate at a first support end; and said first jack member is coupled between said first rod and said first transverse bar to drive the movement of said first support frame such that when said first support frame is in the first normal position, said first support ends of said first support arms are close to the ground, and such that when said first support frame is in the first elevated position, said first support ends of said first support arms are remote from the ground.

3. The foldable bed according to claim 2, further comprising a leg assembly which is configured to sustain said first and second base frames in the unfolded position, and which includes a plurality of legs.

4. The foldable bed according to claim 2, wherein said first reinforcing plate has a first mounted region mounted on said first rod, a first abutting region configured to be brought into abutting engagement with said second rod when said first and second base frames are in the unfolded position, and a first pivot region disposed between said first mounted region and said first abutting region.

5. The foldable bed according to claim 4, wherein said reinforcing unit further includes a second reinforcing plate which has a second mounted region mounted on said second rod, a second abutting region configured to be brought into abutting engagement with said first rod when said first and second base frames are in the unfolded position, and a second pivot region disposed between said second mounted region and said second abutting region; and a first pivot pin extending along a pin axis through said first and second pivot regions so as to permit rotation of said first reinforcing plate relative to said second reinforcing plate during conversion of said first and second base frames between the folded and unfolded positions.

6. The foldable bed according to claim 5, which comprises a plurality of said reinforcing units that are displaced from each other in the transverse direction.

7. The foldable bed according to claim 5, further comprising a pair of pivotal connection units, each of which includes a first connection plate having a first connection end which is connected to said front pivot end segment of a respective one of said front bars, and a first pivotal end which is opposite to said first connection end, a second connection plate having a second connection end which is connected to said rear pivot end segment of a respective one of said rear bars, and a second pivotal end which is opposite to said second connection end, and a second pivot pin which extends along the pin axis through said first and second pivotal ends so as to permit said rear pivot end segment to be pivotally connected to said front pivot end segment of said respective front bar, and to permit rotation of said first connection plate relative to said second connection plate during the conversion of said first and second base frames between the folded and unfolded positions.

8. The foldable bed according to claim 5, wherein said first jack member includes a first rest end which is coupled to one of said first rod and said first transverse bar, and a first pivoted end which is pivotally mounted to the other of said first rod and said first transverse bar so as to permit said first support frame to be driven to move between the first normal position and the first elevated position.

9. The foldable bed according to claim 8, wherein said first rest end is coupled to said first transverse bar, and said first pivoted end is pivotally mounted to said first rod, said foldable bed further comprising:

a first connection pin extending through said first pivoted end in the transverse direction to terminate at two first pin ends; and a pair of first connection pieces which respectively connect said first pin ends with said first rod so as to permit said first pivoted end to be pivotally mounted to said first rod.

10. The foldable bed according to claim 8, further comprising:

a second support frame including a second transverse bar extending in the transverse direction to terminate at two second end segments which are pivotally connected to said rear intermediate segments of said rear bars, respectively, and a pair of second support arms each extending radially from a respective one of said second end segments to terminate at a second support end; and a second jack member coupled between said second rod and said second transverse bar so as to permit said second support frame to be driven by said second jack member to move between a second normal position, where said second support ends of said second support arms are close to the ground, and a second elevated position, where said second support ends of said second support arms are remote from the ground.

11. The foldable bed according to claim 10, wherein said second jack member includes a second rest end which is coupled to one of said second rod and said second transverse bar, and a second pivoted end which is pivotally mounted to the other of said second rod and said second transverse bar so as to permit said second support frame to be driven to move between the second normal position and the second elevated position.

12. The foldable bed according to claim 11, wherein said second rest end is coupled to said second transverse bar, and said second pivoted end is pivotally mounted to said second rod, said foldable bed further comprising:

a second connection pin extending through said second pivoted end in the transverse direction to terminate at two second pin ends; and a pair of second connection pieces which respectively connect said second pin ends with said second rod so as to permit said second pivoted end to be pivotally mounted to said second rod.

* * * * *